US009126721B2

(12) United States Patent
Dye et al.

(10) Patent No.: US 9,126,721 B2
(45) Date of Patent: Sep. 8, 2015

(54) PALLET SKIRT

(75) Inventors: Robert G. Dye, Montebello, NY (US); William Hinch, Marlton, NJ (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 501 days.

(21) Appl. No.: 12/725,650

(22) Filed: Mar. 17, 2010

(65) Prior Publication Data

US 2011/0226649 A1 Sep. 22, 2011

(51) Int. Cl.
*B65D 19/00* (2006.01)
*B65D 19/38* (2006.01)
*B65D 61/00* (2006.01)

(52) U.S. Cl.
CPC ..... *B65D 19/38* (2013.01); *B65D 61/00* (2013.01); *B65D 2519/0096* (2013.01); *B65D 2519/00273* (2013.01); *B65D 2519/00293* (2013.01); *B65D 2519/00298* (2013.01); *B65D 2519/00323* (2013.01); *B65D 2519/00333* (2013.01); *B65D 2519/00373* (2013.01)

(58) Field of Classification Search
USPC ..... 206/386, 595–600, 784, 815, 425, 206/525.1; 150/154; 229/103.2, 122.21, 229/120.24, 120.06, 101
See application file for complete search history.

(56) References Cited

U.S. PATENT DOCUMENTS

| | | | | |
|---|---|---|---|---|
| 4,702,409 | A * | 10/1987 | Osborne | 229/125 |
| 5,310,063 | A * | 5/1994 | Skolasinski | 206/600 |
| 5,318,219 | A * | 6/1994 | Smith | 229/117.05 |
| 5,918,744 | A * | 7/1999 | Bringard et al. | 206/596 |
| 7,861,865 | B2 * | 1/2011 | Green | 206/600 |
| 2005/0040063 | A1 * | 2/2005 | Churvis et al. | 206/386 |
| 2006/0118456 | A1 * | 6/2006 | Macasaet et al. | 206/600 |
| 2006/0124712 | A1 * | 6/2006 | Weimer, Jr. | 229/120.26 |

* cited by examiner

*Primary Examiner* — Anthony Stashick
*Assistant Examiner* — Robert Poon
(74) *Attorney, Agent, or Firm* — Matthew M. Eslami

(57) ABSTRACT

A pallet skirt for covering a stack of pallets on which product is supported and displayed. The skirt has a shipping configuration wherein the perimeter and height of the skirt are approximately the same as the perimeter and height of the product, and a display configuration in which the perimeter and height of the skirt are expanded to cover the stack of pallets. Pleated folds in two corners of the skirt enable its perimeter to be contracted for the shipping configuration and expanded for the display configuration. A horizontal score in the side walls enables the side walls to be folded to reduce the height of the skirt for the shipping configuration and to be unfolded for the display configuration. A horizontal flange on the top edge of the skirt covers the marginal edge of a pallet on which the product is supported during display.

12 Claims, 8 Drawing Sheets

PALLET SKIRT

FIELD OF THE INVENTION

This invention relates generally to product displays, and more particularly to a skirt for covering a pallet or pallets supporting product at a point of sale.

BACKGROUND OF THE INVENTION

Products shipped to retail club stores such as Costco, BJ's and Sam's Club, for example, are commonly displayed for sale to the public in the bulk container in which the products were shipped. For most products, placing the container on the floor is not satisfactory because the consumer would have to bend over to closely view and/or access the product. It is preferable, therefore, to support the container in an elevated position to bring the product to eye level and make it more easily accessible to the consumer. Since product shipped in bulk containers typically is palletized, extra pallets become available at the retail establishment as product is sold and containers are emptied. It is a common practice for the retailer to stack several of these pallets on top of one another and to support the container on top of the stack of pallets in order to elevate the container to a suitable position.

Because a stack of pallets is unsightly, a skirt has been developed for placement around the stack to hide it from view. The currently available skirt is an open-ended tubular structure having a fixed height dimension and one or more pleated corners that enable the width and length dimensions of the skirt to be collapsed to a reduced perimeter size so that it can be placed on top of the pallet and around the product for shipping. In this regard, palletized bulk containers generally do not extend to the edges of the pallet but are inset from the edges, whereby the edges of the pallet project beyond the perimeter of the container. The collapsed skirt is supported on these projecting edges. At the point of display and sale, after the palletized bulk container of product is placed on a stack of empty pallets to support the container in an elevated position, the pleated corners are unfolded to expand the skirt to a larger perimeter size to enable it to be moved from around the container of product and slid down over the stack of pallets to hide them from view.

One example of a packaging system for shipping product to a point of sale comprises a palletized bulk container with length and width dimensions of 44×36 inches and a height dimension of approximately 17 inches, shipped on a 48×40 inch pallet, whereby the outer edges of the pallet project approximately 2 inches beyond the perimeter of the container. In order to support this container at approximately eye level, or at an elevation of about 3 feet, it and the pallet on which it is shipped are supported on a stack of 6 empty pallets. Accordingly, in order for the presently available skirt to cover and hide the stack of 6 empty pallets plus the pallet on which the product is shipped, it must have a height dimension of approximately 35 inches. When this skirt is placed on a pallet in surrounding relationship with a container for shipping the container to a point of sale, and the container has a height of 17 inches, the upper end of the skirt extends above the top of the container by approximately 17 inches. This results in a large void space within the upper portion of the skirt extending above the container, resulting in a much larger shipping cube than necessary and making it difficult if not impossible to stack the palletized containers on top of one another without placing some form of reinforcing filler material in the void space. It should be noted that the dimensions given above are for example only and the invention has equal applicability to containers and pallets having other dimensions.

Although the currently available skirt obscures most of the stack of pallets when used in a packaging system as described above, it leaves exposed to view the top marginal surface of the pallet on which the container was shipped. More important, however, is the void space within the upper portion of the skirt above the container during shipping, as a consequence of the fixed vertical dimension of the skirt. Further, use of the conventional pallet skirt increases cost and labor for both the shipper and the retailer.

It would be desirable to have a packaging system comprising a container supported on a pallet, with a skirt adapted to cover a stack of empty pallets on which the container is supported at a point of sale, wherein the skirt covers not only the stack of pallets but also the upper marginal edges of the pallet on which the container is directly supported, and wherein the height of the skirt can be adjusted so that it does not extend above the container during shipping, thereby eliminating the void space that results with the currently available skirt.

SUMMARY OF THE INVENTION

The present invention comprises an open-ended pallet skirt for covering and obscuring from view a stack of pallets on which product is supported and displayed at a point of sale. The skirt is cut and scored so that it can be folded into a shipping configuration in which the perimeter and height of the skirt are reduced, or into a display configuration in which the perimeter and height of the skirt are expanded. The skirt has an open-ended tubular configuration that is generally rectangularly shaped in plan view and has opposed side walls with top and bottom edges. First means in the side walls enable the perimeter of the skirt to be contracted to its shipping configuration wherein the skirt is adapted to rest on an outer marginal edge of a pallet in surrounding relationship to product supported on the pallet, and expanded to its display configuration adapted to extend downwardly past the outer marginal edges of a stack of pallets on which the product is supported to obscure the pallets and expose the product. If desired, suitable graphics may be provided on the skirt for display at the point of sale. Further, it should be understood that the skirt of the invention could be used to cover objects other than a stack of pallets on which the product is supported for display. For example, the product could be supported for display on top of a large box or other object.

The first means comprises vertical scores at two corners of the skirt that define pleated folds that can be folded to place the skirt in its contracted condition with a reduced perimeter for shipping, and unfolded at a point of sale to expand the perimeter of the skirt so that it can be moved downwardly into position wrapped around a stack of pallets on which the container is supported. Instead of the vertical scores, other means such as an elastic panel, for example, could be provided in one or more corners to enable the perimeter of the skirt to be contracted and expanded.

The second means comprises horizontal scores in the sidewalls of the skirt that enable the skirt to be folded into its reduced height configuration with a first height substantially commensurate with the height of the container during shipping, and at the point of sale unfolded to its display configuration wherein the height of the skirt is increased to a second height to fully cover the stack of pallets on which the container is supported for display. The flange at the top edge of the skirt is folded over 180 degrees during shipping, and this flange automatically opens or unfolds to a horizontal position to cover the top marginal edge of the pallet on which the container is directly supported.

Due to the reduced size of the shipping cube of the package of the invention as a result of making the height of the skirt the same as the height of the container during shipping, more packages can be stacked in transit or storage, fewer packing fillers are required than with previous versions, and labor is reduced both when preparing the package for shipping and when placing the container on display at the point of sale. The skirt of the invention satisfies the design requirements of each club store chain (e.g., Sam's Costco and B.J.'s), which is not achieved with current designs.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF THE INVENTION

Figure 1:
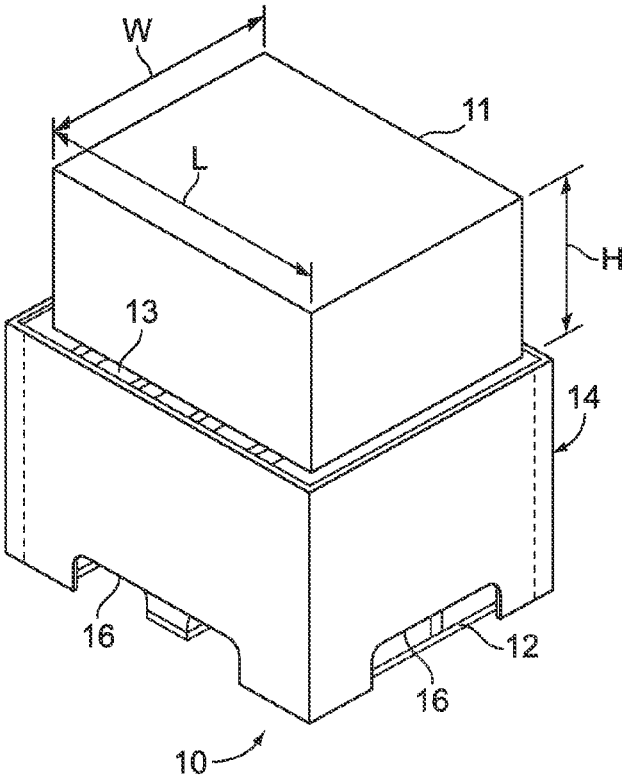
FIG. 1 Prior Art
FIG. 1 is a top perspective view of a prior art packaging system in its configuration for display at a point of sale, in which a pallet skirt is disposed in covering relationship to the perimeter of a stack of pallets on which a product shipping container is supported.
Figure 2:
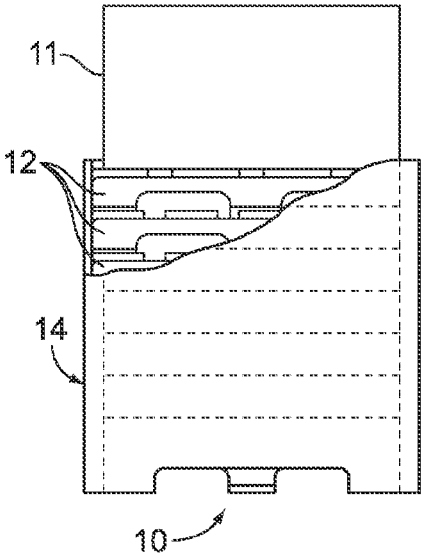
FIG. 2 Prior Art
FIG. 2 is a side view in elevation of the packaging system of FIG. 1, with portions broken away to show part of the stack of pallets on which the container is supported.
Figure 3:
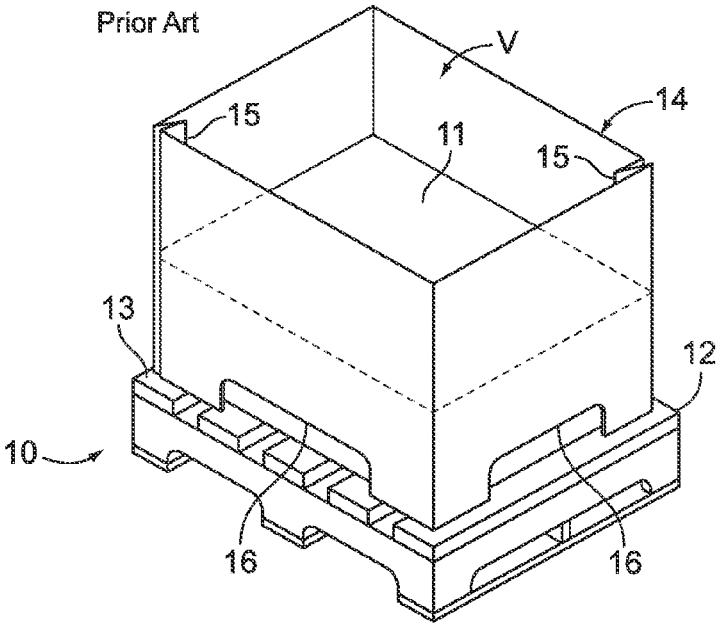
FIG. 3 Prior Art
FIG. 3 is a top perspective view of the packaging system of FIG. 1, shown in its configuration for shipping.

Referring more specifically to the drawings, a conventional packaging system is indicated generally at 10 in FIGS. 1-3. With reference first to FIG. 3, this packaging system comprises a shipping container 11 for shipping product to a point of sale. The container is supported on a pallet 12 and has a perimeter smaller than the perimeter of the pallet, whereby a marginal edge 13 of the pallet projects beyond the perimeter of the container. An open-ended tubular skirt 14 is wrapped around the container and supported on top of the pallet 12. Vertical scores define pleated folds 15 at two diagonally opposite corners of the skirt, and in the shipping configuration as shown in FIG. 3 these pleats are folded to contract the perimeter of the skirt so that it closely surrounds the container. Cutouts 16 are provided in the bottom edges of the skirt to provide clearance for the tines of a forklift or pallet jack A typical container of the type with which the present invention is concerned has a length dimension L of about 44 inches, a width dimension W of about 36 inches, and a height dimension H of about 17 inches. This container normally is shipped on a 48×40 inch pallet, whereby the edges of the pallet project approximately 2 inches beyond each side of the container. For shipping, the container is placed on a single pallet and shipped to a point of sale. At so-called big box stores, or club stores, the product typically is left in the container for display and sale. To facilitate viewing of the product and access to it, the retailer may place a stack of six pallets on the floor and then support the container and its shipping pallet on top of this stack. The stack of pallets, including that on which the container is shipped, typically has a height of about 35 inches. This brings the container to approximately eye level. Since a stack of pallets is considered unsightly at the point of sale, the skirt 14 has been developed to cover the stack of pallets, and in order for the skirt to have sufficient height to cover the stack of pallets, it is given a height of about 35 inches. The conventional skirt has a fixed height, and when wrapped around the container for shipping, as shown in FIG. 3, it projects at its upper end approximately 17 inches above the container. This results in a large void space V above the container. The shipper generally fills this space with cardboard or other material, resulting in extra labor and cost of material. Additionally, the shipping cube is unnecessarily large and more space is required for shipping and storage than would otherwise be required. Moreover, stacking of packaging systems 10 on top of one another is limited, and the filler material placed in the void V by the shipper must be removed and discarded by the retailer, increasing labor, cost and inconvenience to the retailer.

The above dimensions are given for illustrative purposes. It should be understood that the invention could be applied to containers and pallets having dimensions other than those given.

Figure 4:
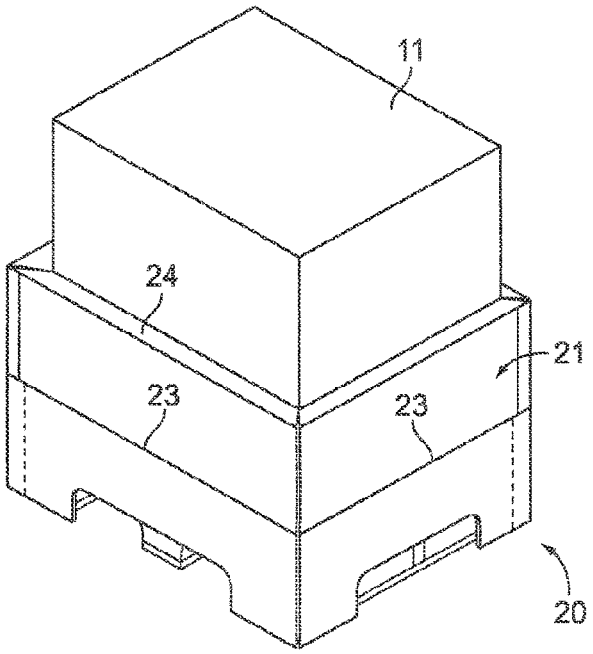
FIG. 4 is a view similar to FIG. 1, but showing a first embodiment of packaging system in accordance with the present invention in its configuration for display at a point of sale.
Figure 5:
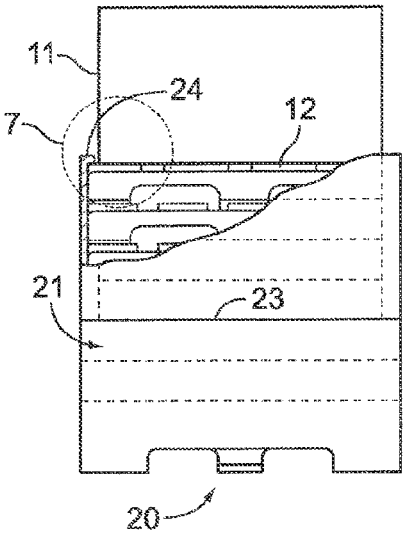
FIG. 5 is a view similar to FIG. 2, but showing the packaging system according to the first embodiment of the present invention.
Figure 6:
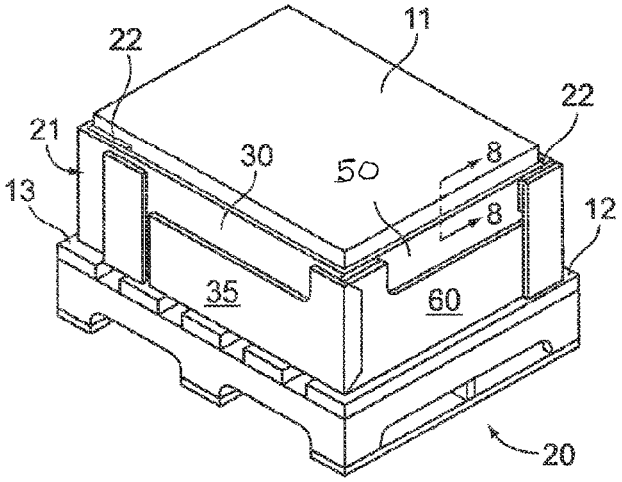
FIG. 6 is a top perspective view of the first embodiment of packaging system according to the invention in its shipping configuration, wherein the skirt is folded so that its height is substantially commensurate with the height of the container.
Figure 7:
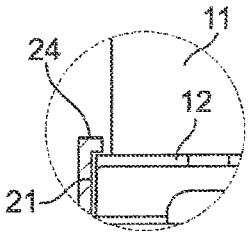
FIG. 7 is an enlarged fragmentary sectional view of the area within the circle 7 in FIG. 2, showing the flange at the top of the skirt of the invention folded into a horizontal position to cover the marginal top surface of the pallet on which the container is supported.

A first embodiment of packaging system according to the invention is shown generally at 20 in FIGS. 4-6, and comprises a container 11 supported on a pallet 12, with the marginal edges 13 of the pallet projecting beyond the sides of the container. The pallet skirt 21 of the invention comprises an open-ended tubular body having a rectangular shape in plan view. Vertical scores at diagonally opposite corners define pleated folds 22 that enable the skirt to be folded to a contracted position with a reduced perimeter, as shown in FIG. 6, so that the skirt may be wrapped around the container and supported on top of the marginal edges of the pallet 12 for shipping, and unfolded at the point of sale to an expanded position for covering the stack of pallets as shown in FIGS. 4 and 5.

Horizontal scores 23 are formed in the walls of the skirt 21 at approximately mid-height so that for shipping and storage the bottom half of the skirt can be folded up to reduce the height of the folded skirt to approximately half its unfolded height. Consequently, in its shipping configuration the skirt of the invention has a height approximately the same as the height of the container, as shown in FIG. 6, eliminating the void space that is produced with the conventional skirt. The skirt of the invention thus eliminates the need for filler materials in its shipping configuration, reduces storage and shipping space, enables the packaging systems to be readily stacked on top of one another, and minimizes labor, cost, and inconvenience for both the shipper and the retailer.

Figure 8:
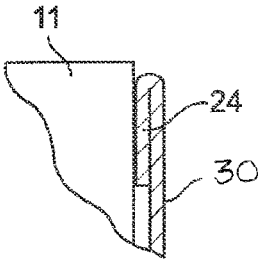
FIG. 8 is an enlarged fragmentary sectional view taken along line 8-8 in FIG. 6, showing how the flange at the top of the skirt is folded 180° during shipping.

A horizontal top flange 24 on the top edge of the skirt of the invention obscures the marginal edge of the top pallet in the stack when the skirt is in its expanded display configuration as shown in FIGS. 4 and 5. This marginal edge of the top pallet would otherwise be visible and is visible when the conventional skirt is used. The flange is folded 180° into the skirt when in the shipping configuration, as shown in FIGS. 6 and 8, and when the skirt is unfolded to its expanded configuration the memory of the material causes the flange to automatically move to the horizontal position shown in FIGS. 4 and 5.

For shipping, the packaging system of the invention typically is banded or shrink wrapped (not shown), and this serves to hold the contracted skirt in position around the container and on top of the pallet. When the skirt is unfolded to its expanded display configuration as shown in FIGS. 4 and 5, suitable fastening means preferably are used to hold the bottom half of the skirt in position folded down around the bottom portion of the stack of pallets. In the embodiment shown in FIGS. 4-11, the fastening means comprises small pieces of double face tape 70 applied between adjacent ends of the bottom panels of the skirt.

Figure 9:
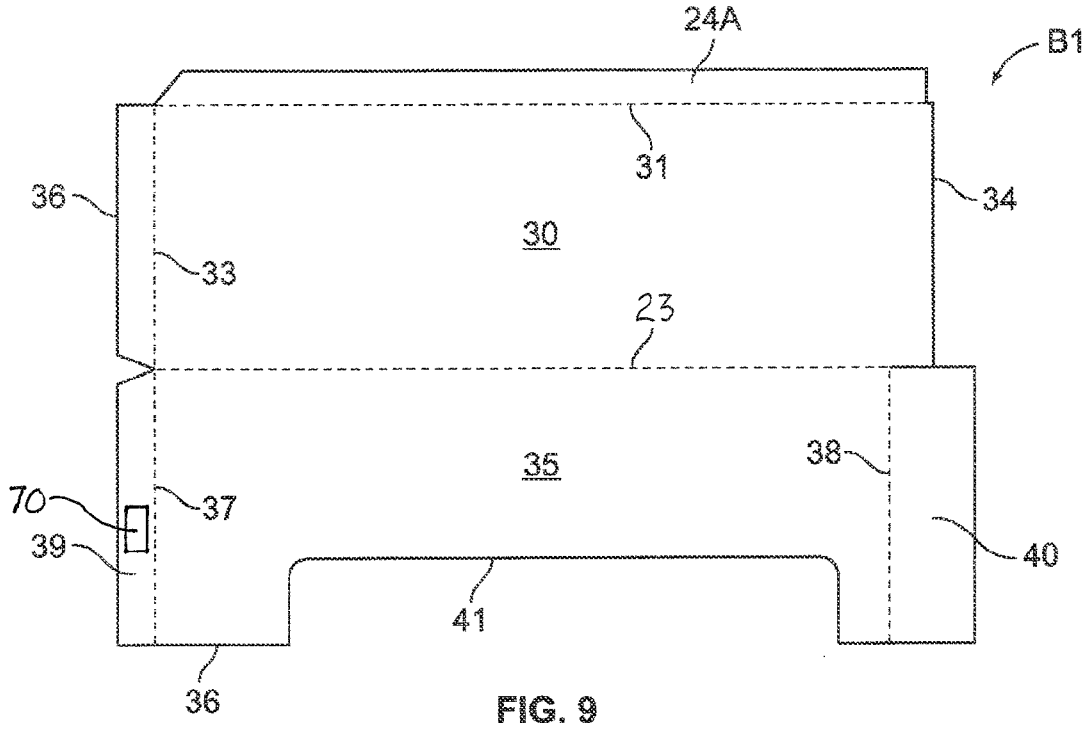
FIG. 9 is a plan view of a blank for making a length panel of the first embodiment of skirt according to the invention.

A blank B1 for making a length panel of the skirt 21 according to the first embodiment of the invention is shown in FIG. 9. As described hereinafter, two length panels B1, B1 ' and two width panels B2, B2' are required to make the skirt. The blank B1 comprises an elongate rectangular upper length panel 30 having a top edge defined by a first score 31, a bottom edge defined by score 23, a first end edge defined by a third score 33, and a second end edge 34. A first component 24A of the top flange 24 is foldably joined to the top edge of panel 30 along first score 31, and a manufacturer's glue flap 36 is foldably joined along third score 33 to the first end of panel 30. An elongate rectangular bottom length panel 35 has an upper edge foldably joined along second score 23 to upper panel 30, a bottom edge 36, a first end edge defined by a fourth score 37, and a second end edge defined by a fifth score 38. A first bottom length panel fastening flap 39 is foldably joined along fourth score 37 to the first end of the bottom length panel, and a second bottom length panel fastening flap 40 is foldably joined to the second end of the bottom length panel along the fifth score 38. An elongate cutout 41 is formed in the bottom edge 36 to provide access for the tines of a forklift when the skirt is operatively deployed around a stack of pallets on which the container is supported.

Blank B1' is identical to blank B1 and corresponding parts are referenced by like reference characters primed. For the sake of brevity, blank B1' is not further described since the structure is identical to blank B1, but it is shown in detail in the drawings.

Figure 10:
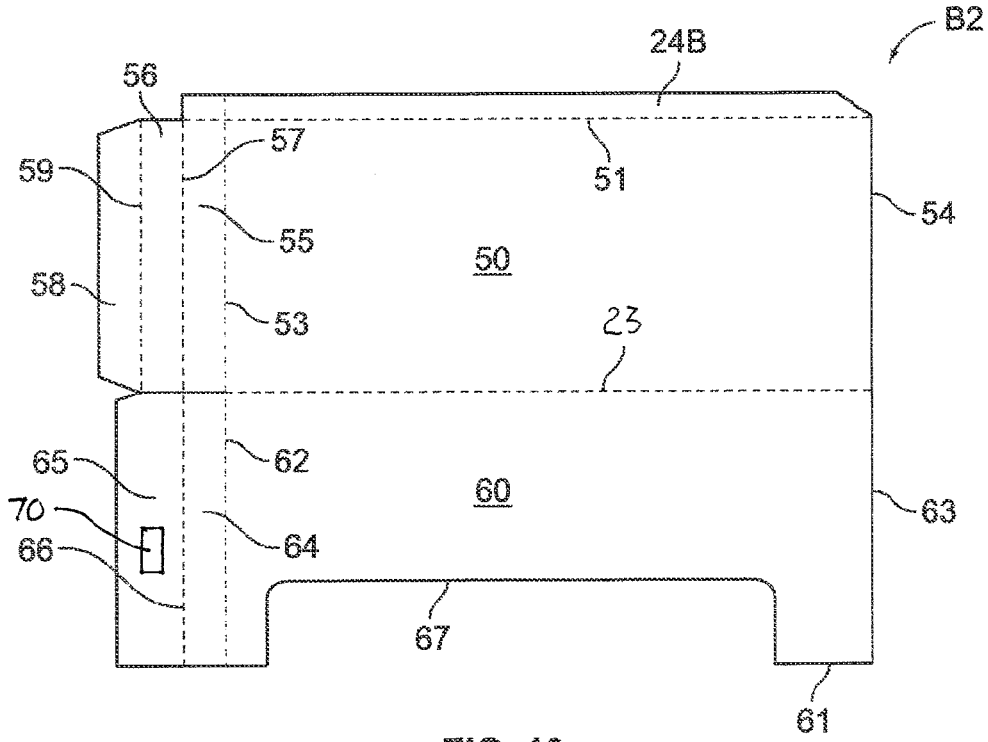
FIG. 10 is a plan view of a blank for making a width panel of the first embodiment of skirt according to the invention.
Figure 11:
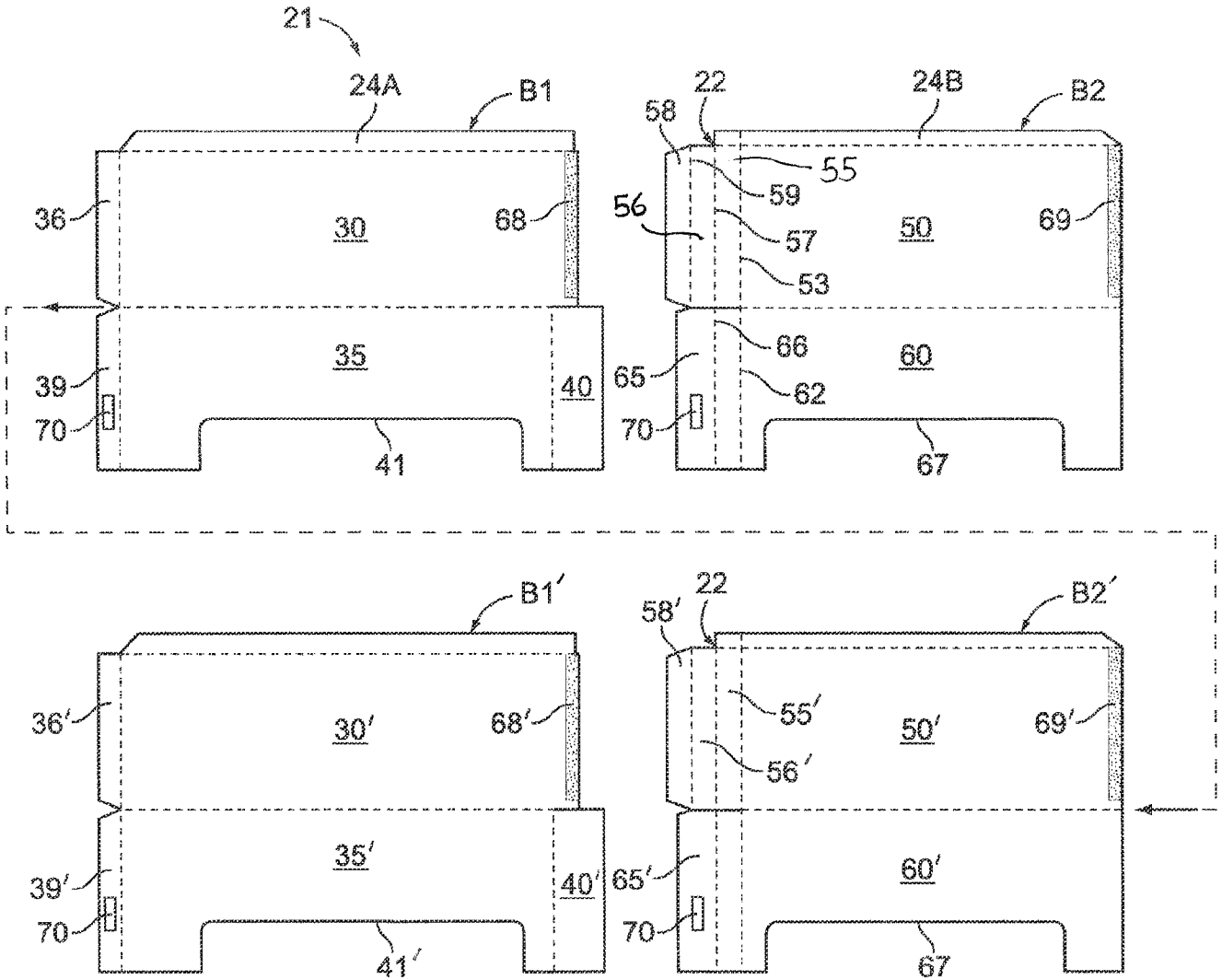
FIG. 11 is an exploded plan view of the length and width panels of the first embodiment of skirt according to the invention arranged in end-to-end relationship to be glued together to make the open-ended tubular skirt of the invention.
Figure 12:
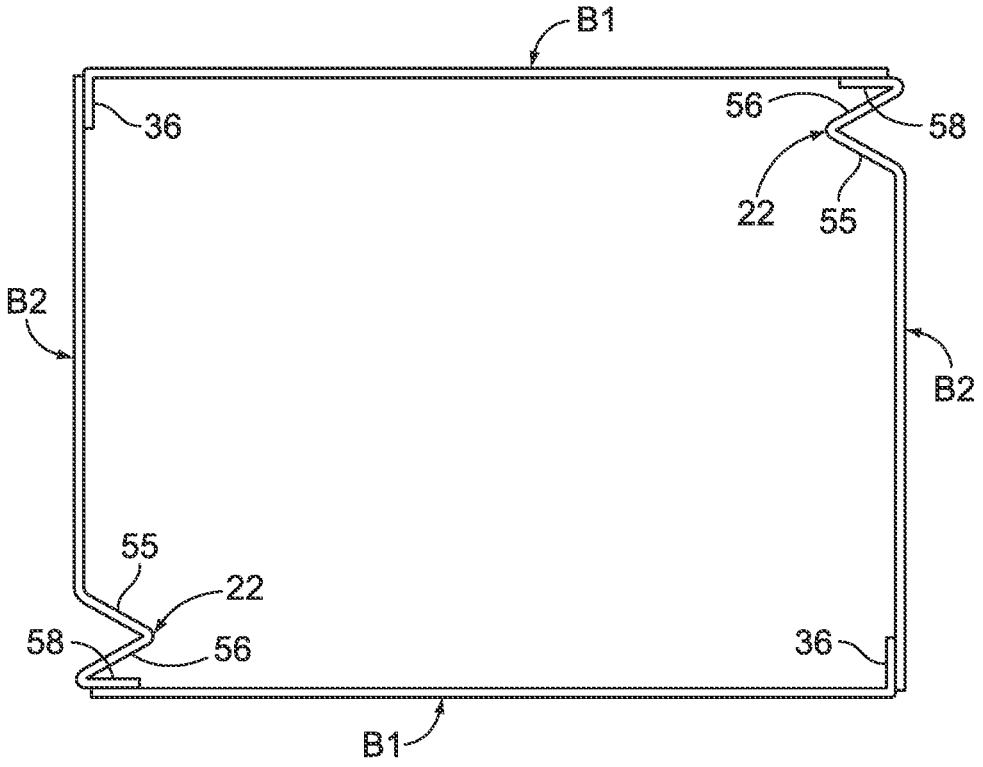
FIG. 12 is a schematic top plan view of the skirt of the invention, with parts omitted for sake of clarity in illustrating the pleated corner feature, showing the pleated folds at diagonally opposite corners of the skirt partially folded inwardly to contract the skirt from its fully unfolded position.
Figure 13:
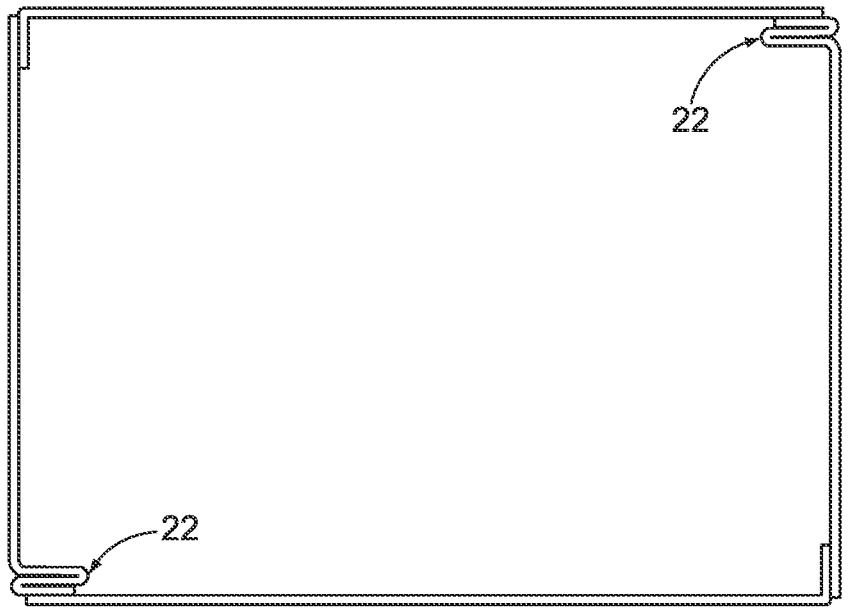
FIG. 13 is a view similar to FIG. 12, showing the pleated corners fully inwardly folded, and showing in broken lines the perimeter of the skirt before it is contracted.

A blank B2 for making a width panel of the skirt 21 according to the first embodiment of the invention is shown in FIG. 10. The blank B2 comprises an elongate rectangular upper width panel 50 having a top edge defined by score 51, a bottom edge defined by score 23, a first end edge defined by score 53, and a second end edge 54. A second component 24B of the top flange 24 is foldably joined to the top edge of panel 50 along score 51. A first upper pleat panel 55 is foldably joined along score 53 to the first end edge of the panel 50, and a second upper pleat panel 56 is foldably joined to pleat panel 55 along a score 57. A manufacturer's glue flap 58 is foldably joined to the second upper pleat panel 56 along a score 59. An elongate rectangular bottom width panel 60 is foldably joined along score 23 to the bottom edge of the upper width panel 50 and has a bottom edge 61, a first end edge defined by score 62, and a second end edge 63. A pleat panel 64 is foldably joined to the first end edge of the bottom width panel along score 62, and a fastening flap 65 is foldably joined to the pleat panel 64 along a score 66. An elongate cutout 67 is formed in the bottom edge 61 to provide access for the tines of a forklift when the skirt is operatively deployed around a stack of pallets on which the container is supported.

Figure 14:
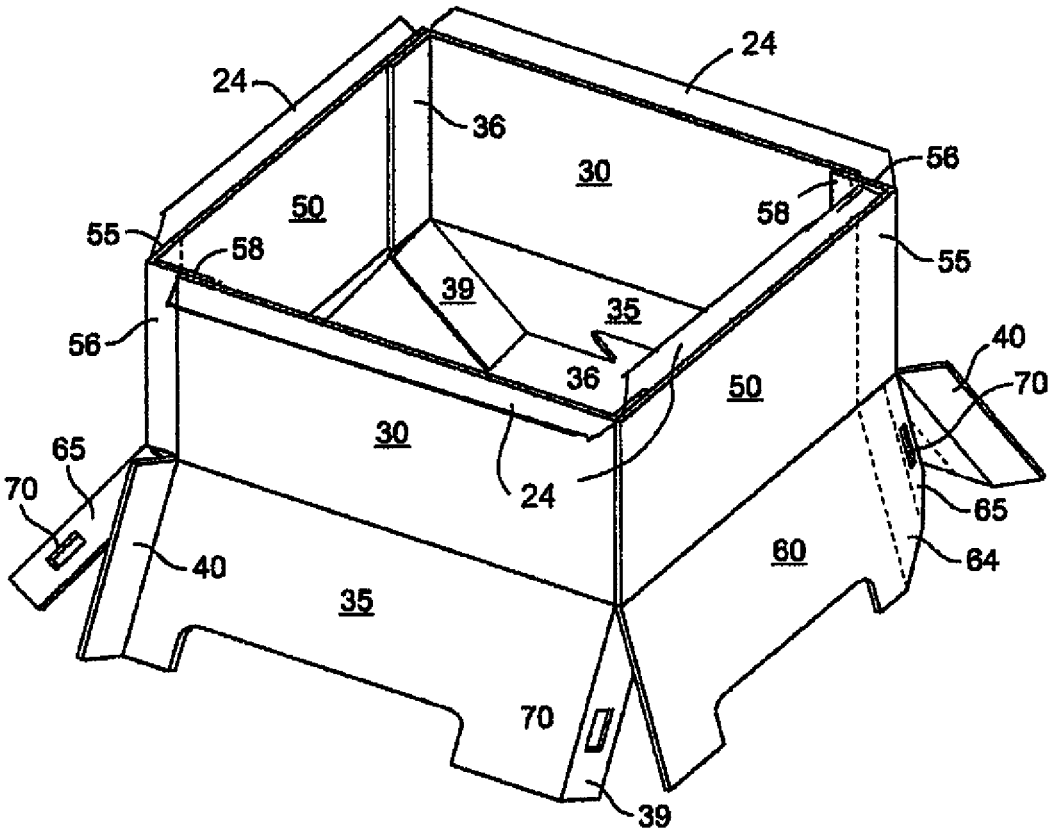
FIG. 14 is a top perspective view of the first embodiment of skirt according to the invention, showing the lower panels of the skirt being folded down into operative position to cover the stack of pallets.
Figure 15:
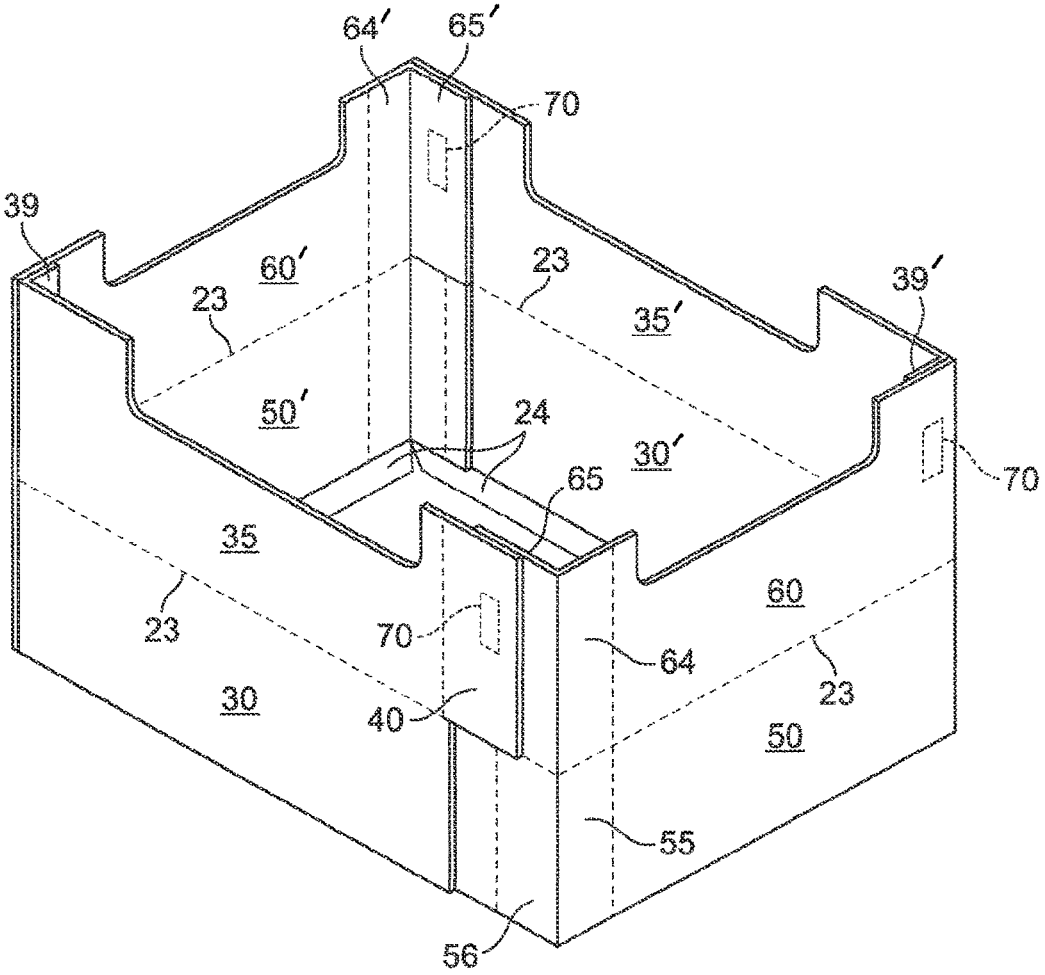
FIG. 15 is an inverted perspective view of the skirt according to the first embodiment of the invention, showing the orientation of the fastening flaps and double face tape that are used to secure the bottom panels of the skirt when it is expanded into operative position.

The skirt 21 is assembled by the manufacturer as follows. The glue flaps 58, 58' on the first ends of the respective width panels 50, 50' are adhered to the shaded areas 68, 68' on the second ends of the respective length panels 30, 30', and the glue flaps 36, 36' on the first ends of the length panels are adhered to the shaded areas 69, 69' on the second ends of the respective width panels 50, 50' to form the open-ended tubular upper portion of the skirt as seen in FIG. 14. The lower panels 35, 35' and 60, 60' are left unattached to each other at this time, but in the embodiment shown in FIGS. 4-15 small pieces of double face tape 70 are applied to fastening panels 39, 39' and 65,65' for securing the bottom panels in position wrapped around the stack of pallets as described hereinafter.

In use, the pleated corner folds 22 are folded to contract the skirt to its reduced perimeter size, the lower panels 35, 35' and 60,60' are folded upwardly to lie alongside the upper panels, and the contracted and folded skirt is wrapped around the container 11 and supported on top of the pallet 12 as shown in FIG. 6. The package is then banded or shrink-wrapped and shipped to a point of sale. At the point of sale, a plurality of empty pallets are stacked on top of one another and the container 11 and pallet 12 on which is shipped are placed on top of the stack. The pleated corners are unfolded to expand the skirt, the bottom panels of the skirt are folded downwardly as depicted in FIG. 14, and the expanded skirt is slid down over the stack of pallets to the position shown in FIGS. 4 and 5. Fastening flaps 39, 39' on the length panels are folded inside the second ends 63, 63' if the width panels and attached thereto with the double face tape, and fastening flaps 65, 65' on the width panels are folded inside flaps 40, 40' on the length panels and secured thereto with the double face tape, thus securing the bottom panels in wrapped relationship around the bottom portion of the stack of pallets. The flange 24 at the top of the skirt automatically moves to a horizontal position when the skirt is expanded, and covers the marginal edge of the pallet 12. The stack of pallets is thus fully covered and hidden from view.

Blank B2' is identical to blank B2 and corresponding parts are referenced by like reference chatters primed. For the sake of brevity, blank B2' is not further described since the structure is identical to blank B2, but it is shown in detail in the drawings.

Figure 16:
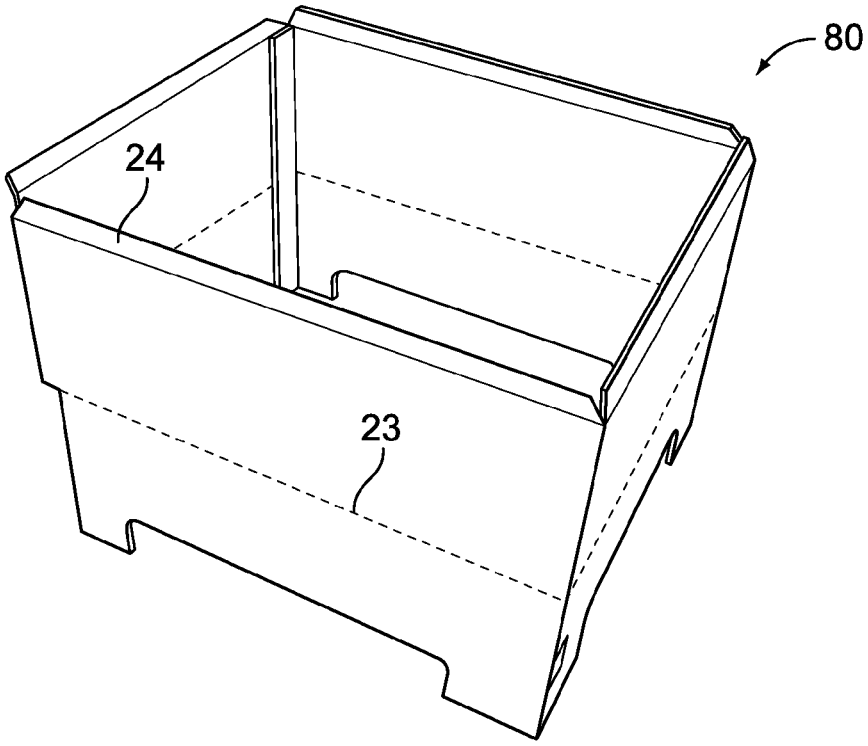
FIG. 16 is a top perspective view of an alternate embodiment of skirt according to the invention, shown in its expanded unfolded position for display, wherein interfitting tabs and slots are provided at the corners to secure the lower panels of the skirt in position.
Figure 17:
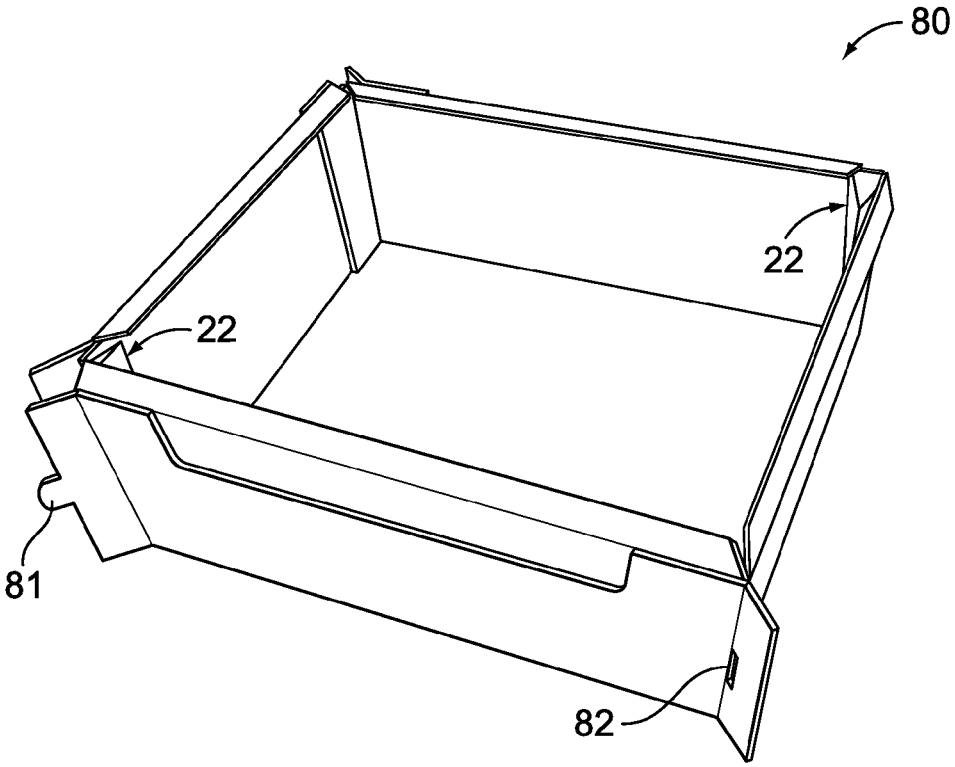
FIG. 17 is a top perspective view of the skirt of FIG. 16, shown in its folded contracted position for shipping.

An alternate embodiment of the invention is indicated generally at 80 in FIGS. 16 and 17. This form of the invention is identical to the first form described above except that the fastening means for securing the bottom panels of the skirt in position around the bottom portion of the stack of pallets comprises interfitting tabs 81 and slots 82 rather than the double face tape used in the first embodiment.

Although two types of fastening means for securing the bottom panels of the skirt in position around the stack of pallets have been illustrated and described herein, it is to be understood that other types of fastening means could be used, or in some cases it may not be necessary to use any fastening means.

Also, means other than the pleated folds could be provided in the corners of the skirt for enabling the perimeter size of the skirt to be expanded and contracted.

In summary, the present invention is directed to an open-ended pallet skirt for covering and obscuring from view a stack of pallets on which product is supported and displayed at a point of sale. The skirt has a shipping configuration in which the perimeter and height of the skirt are reduced, and a display configuration in which the perimeter and height of the skirt are expanded. The skirt comprises opposed side walls having top and bottom edges and defining a generally rectangular shape in plan view. First means in the side walls that enable the perimeter of the skirt to be contracted to its shipping configuration and expanded to its display configuration. And second means in the side walls that enable the side walls to be folded to reduce their height to the shipping configuration, and unfolded to increase their height to the display configuration. The pallet skirt has flanges that are on the top edges of the side walls. The flanges extend horizontally inwardly of the skirt in its display configuration to cover a marginal edge portion of a pallet on which the product is supported.

The first means comprises vertical scores in at least two corners of the skirt. The scores define pleated folds in the corners that are folded to reduce the perimeter of the skirt to its shipping configuration and unfolded to increase the perimeter to its display configuration. The second means comprises a horizontal score in the side walls that enable upper and lower portions of the side walls to be folded relative to one another to reduce the height of the side walls to the shipping configuration and unfolded to increase the height to the display configuration. Each of the side walls comprises an upper panel and a lower panel foldably joined to the upper panel along a horizontal score. The horizontal scores comprise the second means and the upper panels of adjacent side walls are secured together in end-to-end relationship in both the shipping configuration and the display configuration. The lower panels of adjacent side walls are free of attachment to one another in the shipping configuration but are attached to one another in the display configuration. The double face tape is applied between adjacent ends of the lower panels to attach them together in the end-to-end relationship in the display configuration.

The interfitting tabs and slots on adjacent ends of the lower panels attach them together in the end-to-end relationship in the display configuration. The flanges are on the top edges of the side walls. The flanges extend horizontally inwardly of the skirt in its display configuration to cover a marginal edge portion of a pallet on which the product is supported. The first means comprises vertical scores in at least two corners of the skirt, the scores define pleated folds in the corners that are folded to reduce the perimeter of the skirt to its shipping configuration and unfolded to increase the perimeter to its display configuration. The second means comprises a horizontal score in the side walls that enable upper and lower portions of the side walls to be folded relative to one another to reduce the height of the side walls to the shipping configuration and unfolded to increase the height to the display configuration.

Each of the side walls comprises an upper panel and a lower panel foldably joined to the upper panel along a horizontal score and the horizontal scores comprises the second means. The upper panels of adjacent side walls are secured together in end-to-end relationship in both the shipping configuration and the display configuration and the lower panels of adjacent side walls are free of attachment to one another in the shipping configuration but are attached to one another in the display configuration. The double face tape is applied between adjacent ends of the lower panels to attach them together in the end-to-end relationship in the display configuration. The interfitting tabs and slots on adjacent ends of the lower panels attach them together in said end-to-end relationship in said display configuration. The side walls comprise two opposed length panels and two opposed width panels and the first means comprises vertical scores in one end of each of the width panel, the scores defining pleated folds that are folded to reduce the perimeter of the skirt to its shipping configuration and unfolded to increase the perimeter to its display configuration.

The side walls comprise two opposed length panels and two opposed width panels and said second means comprises a horizontal score in said side walls that enable upper and lower portions of the side walls to be folded relative to one another to reduce the height of the side walls to the shipping configuration and unfolded to increase the height to the display configuration. The side walls comprise two opposed length panels and two opposed width panels and the first means comprises vertical scores in one end of each said width panel, said scores defining pleated folds that are folded to reduce the perimeter of the skirt to its shipping configuration and unfolded to increase the perimeter to its display configuration. The second means comprises a horizontal score in the side walls that enable upper and lower portions of the side walls to be folded relative to one another to reduce the height of the side walls to the shipping configuration and unfolded to increase the height to the display configuration. product is supported for display, the width panel blank comprises an elongate rectangular upper width panel having a top edge defined by a first score. A bottom edge is defined by a second score parallel to and spaced from the first score. A first end edge is defined by a third score perpendicular to the first and second scores, and a second end edge is spaced from and parallel to the third score. A top flange is foldably joined along the first score to the top edge of the upper width panel. A first pleat panel is foldably joined along the third score to the first end edge of the upper width panel, and a second pleat panel is foldably joined to the first pleat panel along a fourth score parallel to and spaced from the third score. A manufacturer's glue flap is foldably joined to the second pleat panel along a fifth score parallel to and is spaced from the fourth score. An elongate rectangular bottom width panel is foldably joined along the second score to the bottom edge of the upper width panel. The bottom width panel having a bottom edge, a first end edge defined by a sixth score perpendicular to the bottom edge and colinear with the third score. A second end edge parallel to and spaced from the first end edge. A pleat panel is foldably joined to the first end edge of the bottom width panel along a seventh score parallel to and spaced from the sixth score. A fastening flap is foldably joined to the pleat panel along an eighth score parallel to and spaced from the seventh score, and an elongate cutout in the bottom edge of the bottom width panel.

A blank for making a width panel of a pallet skirt having two width panels and two length panels that form an open-ended tubular skirt for covering a stack of pallets on which product is supported for display, the width panel blank comprises an elongate rectangular upper width panel having a top edge defined by a first score. A bottom edge is defined by a second score parallel to and spaced from the first score. A first end edge is defined by a third score perpendicular to the first and second scores, and a second end edge is spaced from and parallel to the third score. A top flange is foldably joined along the first score to the top edge of the upper width panel. A first pleat panel is foldably joined along the third score to the first end edge of the upper width panel, and a second pleat panel is foldably joined to the first pleat panel along a fourth score parallel to and spaced from the third score. A manufacturer's glue flap is foldably joined to the second pleat panel along a fifth score parallel to and is spaced from the fourth score. An elongate rectangular bottom width panel is foldably joined along the second score to the bottom edge of the upper width panel. The bottom width panel having a bottom edge, a first end edge defined by a sixth score perpendicular to the bottom edge and colinear with the third score. A second end edge parallel to and spaced from the first end edge. A pleat panel is foldably joined to the first end edge of the bottom width panel along a seventh score parallel to and spaced from the sixth score. A fastening flap is foldably joined to the pleat panel along an eighth score parallel to and spaced from the seventh score, and an elongate cutout in the bottom edge of the bottom width panel.

While particular embodiments of the invention have been illustrated and described in detail herein, it should be understood that various changes and modifications may be made in the invention without departing from the spirit and intent of the invention as defined by the appended claims.

What is claimed is:

1. An open-ended pallet skirt for covering and obscuring from view a stack of pallets on which product is supported and displayed at a point of sale, said skirt having opposed sidewalls defined by two width panels and two length panels, said width panels comprising an upper width panel and a lower width panel and said length panels comprising an upper length panel and a lower length panel, said width panels and length panels being cut and scored so they can be folded into a shipping configuration in which the perimeter of the skirt is reduced so it rests on top of a pallet around product supported on the pallet, and the height of the skirt is reduced so it has a vertical height approximately the same as the product supported on the pallet, or into a display configuration in which the perimeter of the skirt is reduced so it extends downwardly over the outer margin of the pallet, and the height of the skirt is expanded so that it covers and obscures from view a stack of pallets on which product is supported, wherein:

said width panels each comprise an elongate rectangular upper width panel having a top edge defined by a first score, a bottom edge defined by a second score parallel to and spaced from the first score, a first end edge defined by a third score perpendicular to the first and second scores, and a second end edge spaced from and parallel to the third score;

a top flange foldably joined along the first score to the top edge of the upper width panel;

a first pleat panel foldably joined along the third score to the first end edge of the upper width panel, and a second pleat panel foldably joined to the first pleat panel along a fourth score parallel to and spaced from the third score;

a manufacturer's glue flap foldably joined to the second pleat panel along a fifth score parallel to and spaced from the fourth score; and an elongate rectangular bottom width panel foldably joined along the second score to the bottom edge of the upper width panel, said bottom width panel having a bottom edge, a first end edge defined by a sixth score perpendicular to the bottom edge and colinear with the third score, a second end edge parallel to and spaced from the first end edge, a pleat panel foldably joined to the first end edge of the bottom width panel along a seventh score parallel to and spaced from the sixth score, a fastening flap foldably joined to the pleat panel along an eighth score parallel to and spaced from the seventh score, and an elongate cutout in the bottom edge of the bottom width panel.

2. The pallet skirt of claim 1, wherein:

said pleat panels comprise vertical scores in at least two corners of the skirt, said scores defining pleated folds in said corners that are folded to reduce the perimeter of the skirt to its shipping configuration and unfolded to increase the perimeter to its display configuration.

3. The pallet skirt of claim 1, wherein:

said upper length and width panels of adjacent said side walls are secured together in end-to-end relationship in both the shipping configuration and the display configuration; and said lower length and width panels of adjacent said side walls are free of attachment to one another when in the shipping configuration.

4. The skirt of claim 3, wherein:

double face tape is on adjacent ends of said lower panels for securing the lower panels together in end-to-end relationship when said skirt is in said display configuration.

5. The pallet skirt of claim 3, wherein:

interfitting tabs and slots on adjacent ends of said lower panels enable the lower panels to be secured together in end-to-end relationship when said skirt is in said display configuration.

6. The pallet skirt of claim 1, wherein:

said upper length and width panels of adjacent said side walls are secured together in end-to-end relationship in both the shipping configuration and the display configuration; and said lower length and width panels of adjacent said side walls are free of attachment to one another in the shipping configuration but are attached to one another in the display configuration.

7. The pallet skirt of claim 6, wherein:

double face tape is on adjacent ends of said lower panels to attach the lower panels together in said end-to-end relationship when said skirt is in said display configuration.

8. The pallet skirt of claim 6, wherein:

interfitting tabs and slots are on adjacent ends of said lower panels to attach them together in said end-to-end relationship when said skirt is in said display configuration.

9. The pallet skirt of claim 1, wherein:

said upper length and width panels comprise two opposed length panels and two opposed width panels, and said bottom panels comprise two opposed length panels and two opposed width panels; and said pleat panels are in one end of each said upper and bottom width panel.

10. The open-ended pallet skirt of claim 1 wherein:

each length panel is rectangularly shaped and has a top edge, a bottom edge, and opposite end edges;

a fold score defines an elongate rectangular upper length panel and an elongate rectangular bottom length panel;

said upper length panel having a top edge corresponding to the top edge of said blank and defined by a first score, a bottom edge parallel to and spaced from the first score and defined by said fold score, one of said end edges comprising a first end edge defined by a third score perpendicular to the first and second scores, and the other end edge comprising a second end edge, said upper length panel forming an upper sidewall panel in a pallet skirt erected from the length panel blank;

a narrow top flange foldably joined along the first score to the top edge of the upper length panel;

a manufacturer's glue flap foldably joined along the third score to the first end of the upper length panel;

said bottom length panel foldably joined along a top edge thereof to the upper length panel along said fold score and having a bottom edge corresponding to the bottom edge of said blank, a first end edge defined by a fourth score perpendicular to the first score and fold score, a second end edge defined by a fifth score parallel to and spaced from the fourth score, and an elongate cutout in the bottom edge, wherein said bottom length panel has a width between its top and bottom edges that is substantially the same as the width of said top length panel between its top and bottom edges, said bottom length panel forming a bottom sidewall panel in a pallet skirt erected from the length panel blank; and a first bottom length panel fastening flap foldably joined along the fourth score to the first end edge of the bottom length panel, and a second bottom length panel fastening flap foldably joined to the second end of the bottom length panel along the fifth score.

11. The pallet skirt of claim 3, wherein:

said lower length and width panels of adjacent side walls are attached to one another when the skirt is in the display configuration.

12. A blank for making a width panel of a pallet skirt having two width panels and two length panels that form an open-ended tubular skirt for covering a stack of pallets on which product is supported for display, said width panel blank comprising:

an elongate rectangular upper width panel having a top edge defined by a first score, a bottom edge defined by a second score parallel to and spaced from the first score, a first end edge defined by a third score perpendicular to the first and second scores, and a second end edge spaced from and parallel to the third score;

a top flange foldably joined along the first score to the top edge of the upper width panel;

a first pleat panel foldably joined along the third score to the first end edge of the upper width panel, and a second pleat panel foldably joined to the first pleat panel along a fourth score parallel to and spaced from the third score;

a manufacturer's glue flap foldably joined to the second pleat panel along a fifth score parallel to and spaced from the fourth score;

an elongate rectangular bottom width panel foldably joined along the second score to the bottom edge of the upper width panel, said bottom width panel having a bottom edge, a first end edge defined by a sixth score perpendicular to the bottom edge and colinear with the third score, a second end edge parallel to and spaced from the first end edge, a pleat panel foldably joined to the first end edge of the bottom width panel along a seventh score parallel to and spaced from the sixth score, a fastening flap foldably joined to the pleat panel along an eighth score parallel to and spaced from the seventh score, and an elongate cutout in the bottom edge of the bottom width panel.

* * * * *